United States Patent [19]

Bodensiek et al.

[11] Patent Number: 4,783,578

[45] Date of Patent: Nov. 8, 1988

[54] MULTI-CONDUCTOR CABLES

[75] Inventors: Paul Bodensiek, Brighton; John A. Marstiller, Marston Mills; Frederick G. J. Grise, Osterville, all of Mass.

[73] Assignee: Flexwatt Corporation, Canton, Mass.

[21] Appl. No.: 899,494

[22] Filed: Aug. 22, 1986

[51] Int. Cl.[4] ..... H01B 7/08

[52] U.S. Cl. ..... 174/117 F; 174/117 PC

[58] Field of Search ..... 174/117 F, 117 FF, 117 PC, 174/68.5, 68 R

[56] References Cited

U.S. PATENT DOCUMENTS

| | | | |
|---|---|---|---|
| 3,168,617 | 2/1965 | Richter | 174/117 FF |
| 3,622,687 | 11/1971 | Doughty | 174/117 F |
| 3,801,388 | 4/1974 | Akiyama et al. | 174/68.5 X |
| 3,833,755 | 9/1974 | Soelberg | 174/117 F |
| 4,118,595 | 10/1978 | Pfahnl et al. | 174/68.5 |
| 4,138,193 | 2/1979 | Olszewski et al. | 174/117 F X |
| 4,149,026 | 4/1979 | Fritz et al. | 174/117 FF X |
| 4,381,420 | 4/1983 | Elliott et al. | 174/117 FF X |
| 4,520,228 | 5/1985 | Hoffman | 174/68.5 |

FOREIGN PATENT DOCUMENTS

| | | | |
|---|---|---|---|
| 2018744 | 11/1971 | Fed. Rep. of Germany | 174/117 FF |
| 2339687 | 2/1975 | Fed. Rep. of Germany | 174/117 FF |
| 2643838 | 12/1977 | Fed. Rep. of Germany | 174/117 FF |

*Primary Examiner*—Morris H. Nimmo

[57] ABSTRACT

A flat, multi-cable assembly is provided by laminating a multiplicity of flat tinned-copper strip conductors between a pair of organic plastic insulating sheets, both of which adhere tightly to each other but at least one of which is not adhered to the copper strip conductors. The copper strip conductors are typically parallel to and spaced-apart (not less than about ⅛ inch) from each other, and the distance between adjacent conductors is typically about equal to (or a major fraction of) the width of the conductors. One of the conductors includes a plurality of electrically isolated portions each of which is electrically connected to a respective one of the other conductors. The latter connections are provided by a plurality of conductor connecting patterns carried on one of the plastic insulating sheets (typically printed thereon using a conductive graphite, nickel or silver ink).

24 Claims, 2 Drawing Sheets

FIG. 1
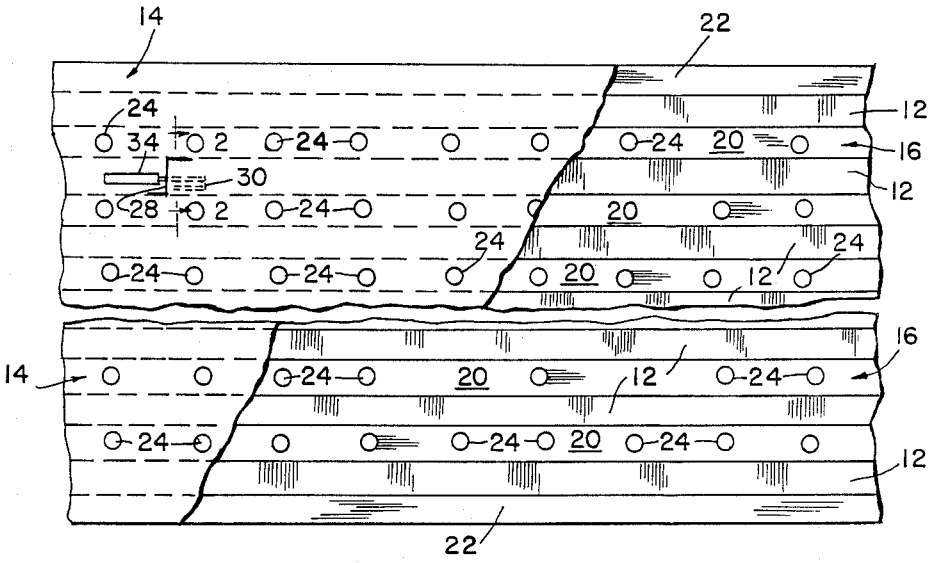
FIG. 2
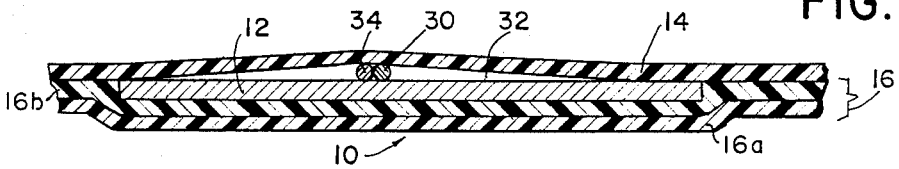
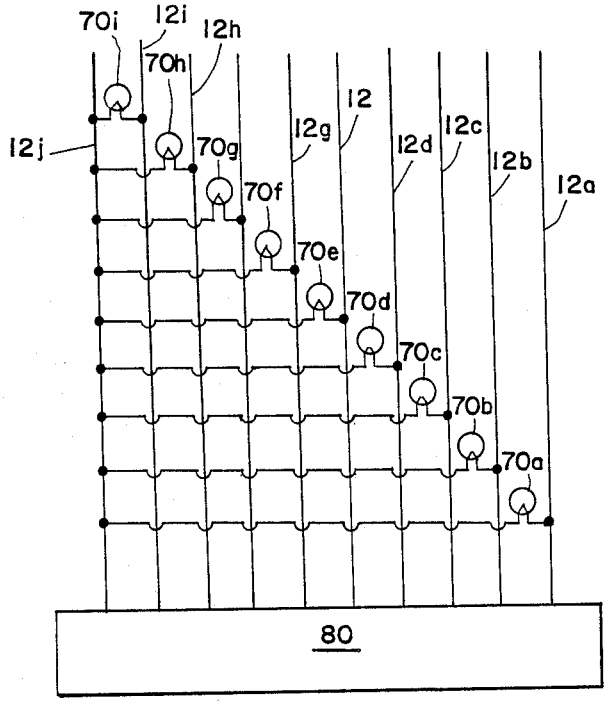
FIG. 3

MULTI-CONDUCTOR CABLES

FIELD OF INVENTION

This invention relates to flat multi-wire cables, and particularly to flat-cable assemblies intended for underrug use.

CROSS REFERENCE TO RELATED APPLICATIONS

The following U.S. Patents are hereby incorporated by reference: U.S. Pat. Nos. 4,485,297 and 4,626,664.

BACKGROUND OF THE INVENTION

Flat, multi-wire cables have a number of uses. One particular, and growing use, involves their placement under rugs or other floorings. For example, hotels have found it desirable to braid small illuminatable arrows in their hall rugs so that, in case of fire, the arrows can be intermittently lighted to direct guests to a safe exit. A number of multi-cable assemblies have been proposed. One type involves closely bunched wires. Another type includes parallel, closely-spaced flat copper conductors adhered between two multi-ply plastic sheets.

Both types have disadvantages. Among other things, it is difficult to make the necessary electrical connections and to mount the cables in place and, the second type also can cause undesirable moisture build-up.

One object of the present invention is to provide a flat multi-cable assembly that has all the advantages of the prior art assemblies, but that is not subject to their drawbacks. Another object is to provide an improved system for connecting the conductors of such multi-cable assemblies.

SUMMARY OF INVENTION

One aspect of the invention features improved flat, multicable assembly provided by laminating a multiplicity of flat tinned-copper strip conductors between a pair of organic plastic insulating sheets, both of which adhere tightly to each other but at least one of which is not adhered to the copper strip conductors. In preferred embodiments, the copper strip conductors are typically parallel to and spaced-apart (not less than about ⅛ inch) from each other, and the distance between adjacent conductors is typically about equal to (or a major fraction of) the width of the conductors.

A second aspect of the invention features a multicable assembly in which one of the conductors includes a plurality of electrically isolated portions each of which is electrically connected to a respective one of the other conductors. In a preferred embodiment of this aspect, the latter connections are provided by a plurality of conductor connecting patterns carried on one of the plastic insulating sheets (typically printed thereon using a conductive graphite, nickel or silver ink).

DESCRIPTION OF DRAWINGS

FIG. 1 is a plan view, slightly simplified and partially broken away, of part of a cable assembly embodying the invention.

FIG. 2 is a section taken at 2—2 of FIG. 1.

FIG. 3 is a schematic illustrating a method of making interconnections.

DESCRIPTION OF PREFERRED EMBODIMENTS

Figure 5:
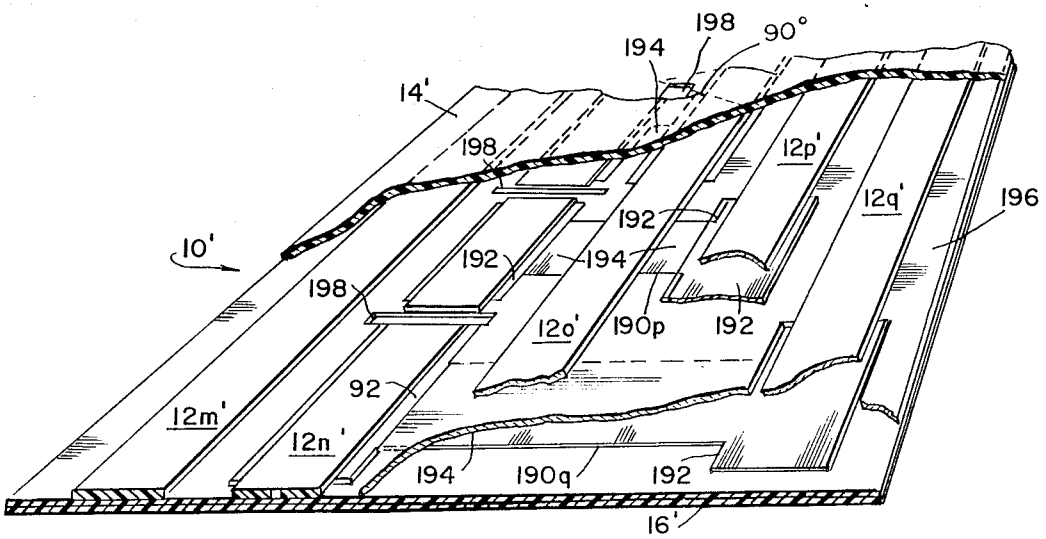
FIG. 5 is a perspective view, slightly simplified and partially in section, illustrating an embodiment of the present invention in which interconnection is provided by conductive material carried on one of the insulating plastic sheets.

Referring now to the FIGS. 1 and 2, there is shown a multicable, flat cable assembly, generally designated 10, comprising a plurality of tined copper strip conductors 12, each of which is 0.003 in. thick and ¼ in. wide, heremetrically sealed between two sheets of organic plastic insulating material, designated 14 and 16, respectively. In the embodiment of FIGS. 1 and 2, cable assembly 10 includes eleven strip conductors, seven of which are shown in FIG. 1.

Sheet 14 is of polyester ("Mylar"), and as illustrated is 0.003 in. thick. Sheet 16 is a two layer co-laminate of polyester (0.002 in. thick) and polyethylene **16*b* (0.003 in. thick), and is oriented with the polyethylene layer 16*b* facing, and in face-to-face contact with, the bottoms (as viewed in FIGS. 1 and 2) of copper strip conductors 12 and the portions of polyester sheet 14 between conductors 12 and along the marginal edges of the assembly 10. In FIG. 1, portions of the upper sheet 14 are removed for purposes of clarity. In practice, sheets 14 and 16** are usually transparent.

As shown, strip conductors 12 are parallel to each other, and the distance between adjacent strip conductors is ¼ inch.

Sheet 16 is bonded to copper strip conductors 12, to the portions 20 of sheet 14 between adjacent strip conductors 12, and also to the marginal edge portions 22 of assembly 10. In the preferred embodiment, the polyethylene layer **16*b* of sheet 16 acts as a hot melt adhesive and is bonded (e.g., heat-sealed by passing sheets 14 and 16 with copper strip conductors 12 therebetween through a conventional laminating machine, in the general mananer described in more detail in aforementioned U.S. Pat. No. 4,690,347) to the bottoms of copper strip conductors 12 and to the portions 20 and 22 of sheet 14 that are in face-to-face contact with the sheet 16. There is no bond between sheet 14** (which is all polyester and has no polyethylene or other adhesive layer) and the copper strip conductors.

In the illustrated embodiment, the areas between adjacent copper strip conductors 12 included a number of holes 24 through the sealed-together plastic sheets 14, 16. As shown, the holes 24 are each about ⅛ inch in diameter and are arranged in lines extending longitudinally of cable assembly 10 midway between adjacent pairs of conductors 12. It will be appreciated that the diameter of the holes is less than the distance between conductors, thereby insuring that the bonded-together plastic of sheets 14, 16 between the edges of the holes and the copper strip conductors 12 on either side of each hole provide both electrical insulation and heremetric sealing.

Reference is now made to FIG. 3 which illustrates, schematically, a typical arrangement of electrical connections between a number (nine are shown) of light emitting diodes (designated **70*a*–70*i*, respectively) and the ten conductors (designated 12*a*–12*j*) respectively of the multi-wire cable of FIGS. 1 and 2. Conductor 12*j* typically acts as a common conductor or ground, and one lead of each light emitting diode 70 is connected to it. The other lead of each light emitting diode 70 is connected to a respective one of the other conductors 12 (e.g., the other lead of light emitting diode 70c is connected to conductor 12c). All of the conductors 12 are connected to a conventional switching assembly, generally designated 80. As will be evident, light emitting diode 12a is illuminated when the switching assembly 80 applies power across conductors 12a and 12h, light emitting diode 12b is illuminated when power is applied across conductors 12b and 12h**, and so forth.

As previously indicated, copper strip conductors 12 are tinned, and the side of each conductor 12 facing sheet 14 is not bondedto plastic sheet 14. This greatly facilitates the ease of making electrical connections to the conductors. For example, the absence of a bond between the conductor 12 and sheet 14 makes it relatively simple to strip back the unadhered plastic 14 from the top of a conductor 12; and, because the exposed copper is tinned, a connecting wire may be soldered directly to it. Similarly, and as shown, a transverse cut 28 may be made in plastic sheet 14 overlying a copper conductor 12, and a short length of low melt solder 30 inserted through the cut into the space 32 between the bottom of the copper strip and the underlying plastic sheet 14. The end (stripped of any insulation) of a connecting wire 34 may then also be inserted into the spaces 32, in close proximity to the solder. If the area is then heated to about 180° F., the solder will melt and thus provide the desired electrical connection. Although only a single view is shown in FIGS. 1 and 2, it will of course be apparent that a connecting wire typically will be attached to each conductor 12 which is to carry current.

Using available automatic soldering equipment, it is also possible to solder directly through the plastic insulating sheet, the temperature at which the soldering takes place being sufficiently great to melt the plastic and permit the solder and wire directly to contact the underlying conductor.

When the cable assembly 10 is to be mounted, for example, on a floor below a rug, nails or staples may be driven through the plastic between adjacent copper strip conductors 12 to hold the assembly in place. Holes 24 permit sufficient air flow to avoid trapping undesirable moisture between the cable assembly and the floor or other surface on which it is mounted.

Figure 4:
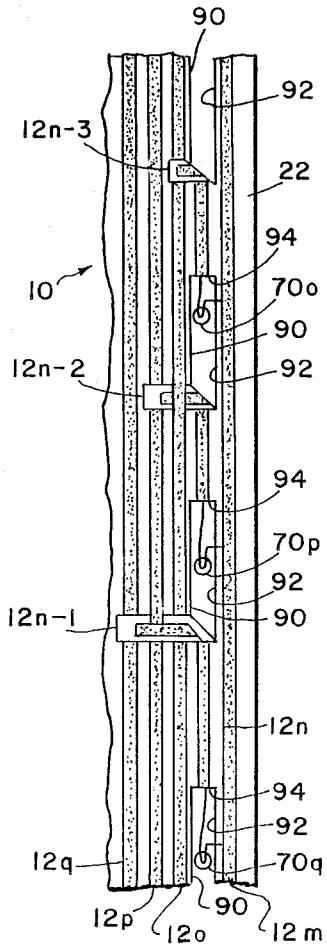
FIG. 4 is a plan, slightly simplied view, illustrating an interconnect system according to the present invention.

Reference is now made to FIG. 4 which illustrates another system for making electrical connections according to the present invention. As shown in FIG. 4, one of the conductors 12 (designated 12m in FIG. 4) acts as a common connector or ground; and one side of each light emitting diode 70 is connected to conductor 12m. The other side of the photodiodes is connected to a respective one of conductors 12o–12q. As will be evident, FIG. 4 shows only five of the ten conductors 12 of cable assembly 10, and similarly shows fewer diodes 70 than would normally be connected to a ten-conductor cable assembly.

According to the system of FIG. 4, conductor 12n is used to make the connection from diodes 70o, 70p and 70q to, respectively, conductors 12o, 12p and 12q. Referring particular to the connection of diode 70p, it will be seen that a portion of conductor 12n (designated 12n-2) has been partially severed from cable assembly by making a pair of longitudinal cuts 90, 92 through the superposed plastic midway between conductors 12m and 12o, and making a transverse cut 94 between and extending between the upper end of longitudinal cuts 90, 92. Conductor portion 12n-2 is thus free on three sides, but at one end it is still connected to the remaining portion of conductor 12n. Conductor portion 12n-2 is then folded (along a fold line 72 adjacent its still connected end and at an about 45° angle to the longitudinal cuts 90, 92) so that it overlies the other of conductors 12 (i.e., conductor 12p) to which it is to be electrically connected, and is then soldered to conductor 12p.

In FIG. 4, cable assembly 10 is oriented with sheet 14 facing upwardly. It thus wil be seen that the partially severed conductor portions are folded over so that the plastic sheet 14 side of the severed portion contacts the plastic sheet 14 covering the conductor to which the folded-over conductor is to be connected; if the partially severed conductor portions were folded the other way, the contacting would be between portions of sheet 16. The plastic sheet portions 14 between the overlapped portions of, e.g., conductor 12p and conductor portions 12n-2 are such that they will melt at a relatively low temperature; and the heat produced during soldering is thus sufficient to melt away the insulating plastic 14 between the two conductor portions to be joined. If low temperature solder is to be used, or it is so desired for any other reason, the portions of plastic sheet 14 overlying the contact points may be stripped away.

As shown in the drawing, conductor portions 12n-1 and 12n-3 are partially cut-out, folded over and soldered to, respectively, conductors 12o and 12q in a similar manner. Very small incandescent bulbs 70o, 70p and 70q (or, if preferred, light emitting diodes or any other auditory or visual signaling devices) are connected between conductor 12m and, respectively, conductor 12o (through conductor portion 12n-3), conductor 12p (through conductor portion 12n-2) and conductor 12q (through conductor portion 12n-31). The connections are made by soldering one leg of each light 70 to conductor 12m and the other leg to a respective portion of conductor 12n. Typically, the lights 70 themselves are positioned in the spaces resulting from cutting away and folding over the connecting conductor portions.

FIG. 5 illustrate another system for forming interconnections between the flat conductors of a multi-wire cable constructed according to the present invention. The cable of FIG. 5 is generally designated 10' and, to a major extent, includes the same components and is constructed in the same manner as cable 10 previously discussed. Corresponding portions of cable 10' are identified by the same numbers used in the description of cable 10, with a differentiating prime (') added.

As shown, cable 10' includes a pair of plastic insulating sheets 14', 16' between which have been laminated a number (five are shown) of parallel, spaced-apart, tinned copper conductors 12'. To electrically connect conductor 12n' to, respectively, conductors 12o', 12p' and 12q', conductive connector patterns, designated 190o, 190p and 190q are printed on the inside surface of sheet 16. Each conductive pattern 190 comprises a conductive material (e.g., graphite, nickel or silver) in a carrier, and is generally in the shape of a block letter "H", comprising two rectangular block portions 192, each about ⅜ inch wide and ¾ inch long centered below and extending longitudinally of a respective one of conductors 12, and a cross-bar portion 194 that extends generally perpendicularly of conductors 12 and electrically connects the two blocks 92. In the illustrated embodiment, the patterns are printed at substantially uniform thickness, and the cross-bar portion 194 of each is about ½ inch wide. In other embodiments, particularly those intended for use in low voltage applications, the widths of the cross-bar portions will be varied so that, although the different cross-bars are of different length, their overall end-to-end resistance are substantially the same. Thus, and with reference to FIG. 5, the cross-bar 194 of the pattern connecting conductors 12*q*′ and 12*n*′ would be printed about three times as wide, and that of the pattern connecting conductors 12*p*′ and 12*n*′ would be printed about twice as wide, as the cross-bar of the pattern connecting adjacent conductors 12*o*′ and 12*n*′.

A screen-printable thermo-plastic polymer dielectric layer 196 (for example, the solvent-based cross-over and tail coatig dielectric sold by Acheson Colloids of Port Huron, Mich. under the designation "electrodag 432SS") is printed over the cross-bar portions 194 of conductive patterns 190 and the exposed (i.e., not covered by conductive patterns 190) inside surface of sheet 16. No dielectric is printed over the rectangular portions 192 of conductive patterns 190, so that there will be good electrical contact between rectangular portions 192 and the portions of conductors 12′ with which they are in face-to-face contact. It will be seen, thus, that conductive pattern 190*o* electrically connects conductors 12*n*′ and 12*o*′, pattern 190*p* connects conductor 12*n*′ to conductor 12*p*′, and that the electrical connection between conductors 12*n*′ and 12*q*′ is provided by pattern 190*q*. To electrically isolate the different connecting portions from each other, portions of conductor 12*n*′ between adjacent connecting patterns 190 are removed. In practice, this is generally done by cutting holes 198 through the entire cable assembly. Each hole 190 has a length (transverse of cable 10′) substantially equal to the width of conductor 12*n*′ plus the distance between adjacent conductors 12′, and is centered on conductor 12*n*′ so that conductor 12*n*′ will be completely severed but heremetrically sealed sheets 14′, 16′ will remain between conductor 12*n*′ and the adjacent conductors 12*m*′ and 12*o*′.

OTHER EMBODIMENTS

For use in, for example, aircraft, the insulating plastic sheets comprising the multi-cable assembly of the present invention may be an insulating organic plastic material which will not support burning (such as polyether sulfone) rather than polyester and/or polyethylene. In these and other circumstances it may also be desirable to provide a construction in which the strip conductors are not adhered to the plastic on either side, in which cases the conductors are held in position solely by the face-to-face adhered insulating plastic material between adjacent conductors and along the marginal edges of the assembly.

Additionally, it may in some circumstances be desirable to color code the copper strip conductors (e.g., by contacting their upper surface with appropriately colored rollers as the strips are introduced between the two plastic sheets), and to print wiring or other instruction on, e.g., one of the plastic sheets.

These and other embodiments will be within the scope of the following claims.

What is claimed is:

1. A flat, multi-cable assembly comprising:

first and second sheets of electrically-insulating organic plastic; and a plurality of strip conductors of electrically conductive metal positioned between said first and second sheets and extending longitudinally of said assembly, said strip conductors being arranged parallel to and spaced apart from each other, the portions of said first and second sheets (i) intermediate respective ones of said strip conductors and (ii) between said strip conductors and the outer side edges of said assembly being adhered to each other, said assembly being characterized in that said first sheet comprises a co-laminate of at least two layers and overlies the surfaces of said strip conductors facing said first sheet, the one of said layers most closely adjacent said conductors comprising a hot melt adhesive and being adhered to the said conductors, and said second sheet overlies but is not adhered to the opposite surfaces of said strip conductors, whereby said second sheet may easily be stripped back from said strip conductors or an electrical connection interposed between said second sheet and a selected one of said strip conductors.

2. The assembly of claim 1 wherein the one of said layers of said first sheet comprising said hot melt adhesive is polyethylene, and another of said layers of said first sheet and said second sheet are both polyester.

3. The assembly of claim 1 wherein said conductive metal strip conductors are tinned copper.

4. The assembly of claim 1 wherein the distance between adjacent ones of said strip conductors is not less than about ⅛ inch.

5. The assembly of claim 4 wherein the distance between adjacent ones of said strip conductors is not more than about 1 inch.

6. The assembly of claim 1 wherein one of said conductors includes a plurality of electrically-isolated conductor portions each of which is electrically connected to another respective one of said conductors.

7. The assembly of claim 6 wherein the said portions of one conductor are electrically isolated by severing said one conductor intermediate adjacent ones of said portions.

8. A flat, multi-cable assembly comprising:

first and second sheets of electrically-insulating organic plastic; and a plurality of strip conductors of electrically conductive metal positioned between said first and second sheets and extending longitudinally of said assembly, said strip conductors being arranged parallel to and spaced apart from each other, the portions of said first and second sheets intermediate respective ones of said strip conductors and between said strip conductors and the outer side edges of said assembly being adhered to each other, said assembly being characterized in that said first sheet overlies the surfaces of said strip conductors facing said first sheet, and said second sheet overlies but is not adhered to the opposite surface of said strip conductors, whereby said second sheet may easily be stripped back from said strip conductors or an electrical connector interposed between said second sheet and a selected one of said strip conductors; and the portion of said sheets between an adjacent pair of said strip conductors includes a plurality of holes spaced therealong, each of said holes having a diameter that is less than the distance between said adjacent pair of strip conductors and said holes are positioned such that the portions of said sheets between said holes and said strip conductors of said pair provide electrical insulation and a heremetric seal.

9. The assembly of claim 8 wherein a said plurality of holes are provided in each of a plurality of said portions of said sheets between a plurality of respective adjacent pairs of said strip conductors.

10. The assembly of claim 8 wherein said holes are circular and have a diameter of not less than about 1/16 inch.

11. A flat, multi-cable assembly comprising:

first and second sheets of electrically-insulating organic plastic; and a plurality of strip conductors of electrically conductive metal positioned between said first and second sheets and extending longitudinally of said assembly, said strip conductors being arranged parallel to and spaced apart from each other, said first sheet overlying the surfaces of said conductors facing said first sheet and said second sheet overlying the surfaces of said conductors facing said second sheet, and the portions of said first and second sheets intermediate (i) respective ones of said strip conductors and (ii) between said strip conductors and the outer side edges of said assembly being adhered to each other, said assembly being characterized in that the surface of one of said sheets facing said conductors carries a plurality of conductive patterns each of which extends between and electrically connects one of said conductors to another of said conductors, each of said patterns including a pair of transversely spaced conductor contact portions each of which engages the respective one of said conductors and said another of said conductors and a connecting portion that extends transversely between and engages said pair of conductor contact portions, at least some of said connecting portions underlie a said conductor other than the said conductors to which the respective said connecting portions are electrically connected, and a layer of dielectric material is provided between each of said connecting portions that underlies a said conductor and the said conductor and electrically insulates the said conductor from the conductors to which the connecting portion is electrically connected.

12. The assembly of claim 11 wherein said dielectric layer covers substantially all of said conductive patterns except for the said conductor contact portions of said conductive patterns.

13. The assembly of claim 12 wherein said conductive material comprises a carrier and a material selected from the group consisting of graphite, nickel and silver.

14. The assembly of claim 11 wherein at least one of said sheets is not adhered to the surfaces of said strip conductors facing the sheet whereby the sheet may easily be stripped back from said strip conductors or an electrical connection interposed between the sheet and a selected one of said strip conductors.

15. The assembly of claim 14 wherein the sheet carrying said conductive patterns is adhered to the surfaces of said strip conductors in face-to-face engagement therewith.

16. The assembly of claim 11 wherein one of said conductive patterns electrically connects one of said conductors to a first selected other one of said conductors and a second one of said conductive patterns electrically connects said one of said conductors to a second selected other one of said conductors.

17. The assembly of claim 16 wherein the portion of said one conductor electrically connected to said one of said conductive patterns is electrically isolated from the portion of said one conductor electrically connected to said second one of conductive patterns.

18. A flat, multi-cable assembly comprising:

first and second sheets of electrically-insulating organic plastic; and a plurality of strip conductors of electrically conductive metal positioned between said first and second sheets and extending longitudinally of said assembly, said strip conductors being arranged parallel to and spaced apart from each other, said first sheet overlying the surfaces of said conductors facing said first sheet and said second sheet overlying the surfaces of said conductors facing said second sheet, and the portions of said first and second sheets (i) intermediate respective ones of said strip conductors and (ii) between said strip conductors and the outer side edges of said assembly being adhered to each other, said assembly being characterized in that the surface of one of said sheets facing said conductors carries a plurality of conductive patterns comprising conductive material printed on said one of said sheets, each of said patterns extends between and electrically connects one of said conductors to another of said conductors and includes a pair of transversely-spaced conductor contact portions each of which engages the respective one of said conductors and a connecting portion that extends transversely between and engages said pair of conductor contact portions, at least some of said connecting portions underlie a said conductor other than the said conductors to which the respective said connecting portions are electrically connected, and a layer of dielectric material is provided between each of said connecting portions that underlies a said conductor and the said conductor and electrically insulates the said conductor from the conductors to which the connecting portion is electrically connected.

19. A flat, multi-cable assembly comprising:

first and second sheets of electrically-insulating organic plastic; and a plurality of strip conductors of electrically conductive metal positioned between said first and second sheets and extending longitudinally of said assembly, said strip conductors being arranged parallel to and spaced apart from each other, said first sheet overlying the surfaces of said conductors facing said first sheet and said second sheet overlying the surfaces of said conductors facing said second sheet, and the portions of said first and second sheets intermediate (i) respective ones of said strip conductors and (ii) between said strip conductors and the outer side edges of said assembly being adhered to each other, said assembly being characterized in that the surface of one of said sheets facing said conductors carries a plurality of conductive patterns each of which extends between and electrically connects one of said conductors to another of said conductors, each of said patterns including a pair of transversely spaced conductor contact portions each of which engages the respective one of said conductors and said another of said conductors and a connection portion that extends transversely between and engages said pair of conductor contact portions, said connecting portions of said conductive patterns are arranged to have substantially equal end-to-end resistance, at least some of said connecting portions underlie a said conductor other than the said conductors to which said connecting portions are electrically connected, and a layer of dielectric material is provided between each of said connecting portions that underlies a said conductors and the said conductor and electrically insulates the said conductor which it underlies from the conductors to which the connecting portion is electrically connected.

20. The assembly of claim 19 wherein the said connecting portions of said conductive patterns are of substantially the same thickness but of different widths.

21. The assembly of claim 19 wherein said portions of said one conductor are electrically isolated by severing said one conductor intermediate said portions thereof.

22. A flat, multi-cable assembly comprising:

first and second sheets of electrically-insulating organic plastic; and a plurality of strip conductors of electrically conductive metal positioned between said first and second sheets and extending longitudinally of said assembly, said strip conductors being arranged parallel to and spaced apart from each other, the portions of said first and second sheets (i) intermediate respective ones of said strip conductors and (ii) between said strip conductors and the outer side edges of said assembly being adhered to each other, said assembly being characterized in that a first portion of one of said conductors is electrically connected to a second one of said conductors, and a second portion of said one conductor is electrically connected to a third one of said conductors, said first and second portions of said one conductor being electrically isolated from each other.

23. The assembly of claim 22 wherein said one of said conductor includes a plurality of electrically-isolated conductor portions each of which is electrically connected to another respective one of said conductors.

24. The assembly of claim 23 wherein the said portions of one conductor are electrically isolated by severing said one conductor intermediate adjacent ones of said portions.

* * * * *

UNITED STATES PATENT OFFICE

CERTIFICATE OF CORRECTION

Patent No. 4,783,578 Dated November 8, 1988

Inventor(s) Paul Bodensiek, John A. Marstiller, Frederick G. J. Grise

It is certified that error appears in the above-identified patent and that said Letters Patent is hereby corrected as shown below:

Col. 1, line 17 "floorings" should be --flooring--
Col. 2, line 18 "polyester" should be --polyester 16a--
Col. 3, line 22 "copper strip" should be --copper strip 12--
Col. 4, line 8 "wil" should be --will--
Col. 5, line 13 "coatig" should be --coating--
Col. 6, line 55 "surface" should be --surfaces--
Col. 9, line 12 "conductors" should be --conductor--
Col. 9, line 14,"conductors" should be --conductor--

Signed and Sealed this

Eighth Day of August, 1989

*Attest:*

*Attesting Officer*

DONALD J. QUIGG

*Commissioner of Patents and Trademarks*